US005397192A

United States Patent [19]

Khormaee

[11] Patent Number: 5,397,192

[45] Date of Patent: Mar. 14, 1995

[54] SHUTTLE-TYPE PRINTERS AND METHODS FOR OPERATING SAME

[75] Inventor: Izadpour Khormaee, West Linn, Oreg.

[73] Assignee: Hewlett-Packard Company, Palo Alto, Calif.

[21] Appl. No.: 146,516

[22] Filed: Nov. 1, 1993

[51] Int. Cl.[6] ..... B41J 21/16

[52] U.S. Cl. ..... 400/708; 400/705.1; 400/279

[58] Field of Search ..... 400/705.1, 708, 279, 400/205

[56] References Cited

U.S. PATENT DOCUMENTS

| | | | |
|---|---|---|---|
| 4,625,275 | 11/1986 | Smith | 400/121 |
| 5,127,752 | 7/1992 | Courtney | 400/705.1 |
| 5,150,977 | 9/1992 | Yoshikawa | 400/708 |
| 5,170,047 | 12/1992 | Beauchamp et al. | 250/202 |
| 5,241,325 | 8/1993 | Nguyen | 345/1.1 |
| 5,299,873 | 4/1994 | Miebori | 400/705.1 |

OTHER PUBLICATIONS

Hewlett-Packard Company Patent Application, "Phase Plate Design for Aligning Multiple Inkjet Cartridges by Scanning a Reference Pattern" Ser. No. 08/055,620 Filed Apr. 30, 1993.

*Primary Examiner*—David A. Wiecking
*Assistant Examiner*—John S. Hilten

[57] ABSTRACT

A printing system for a shuttle-type printer includes a platen and a carriage configured to move bidirectionally across the platen. An optically responsive demarcation is provided on the platen outside of the media feed path. A printhead and an optical sensor are disposed on the carriage. During operation, the carriage is operable to position the optical sensor over the platen demarcation, whereby the optical sensor generates a position signal when it detects the platen demarcation. A control subsystem is operably coupled to the optical sensor to determine absolute position of the carriage relative to the platen in response to optical identification of the platen demarcation by the optical sensor. Several methods for operating such a printing system are also described.

5 Claims, 3 Drawing Sheets

SHUTTLE-TYPE PRINTERS AND METHODS FOR OPERATING SAME

TECHNICAL FIELD

This invention relates to shuttle-type printers and methods for operating them.

BACKGROUND OF THE INVENTION

Shuttle-type printers are a class of printers having a movable shuttle or carriage that traverses back and forth across a printing surface. A printhead is mounted on the shuttle and synchronized with shuttle movement to print desired images. The shuttle class of printers includes both impact printers, such as dot matrix and daisy-wheel printers, and non-impact printers, such as ink-jet printers.

A shuttle drive mechanism maneuvers the shuttle over the printing surface. The shuttle drive mechanism typically consists of a motor, and a belt and pulley assembly which operably couples the shuttle to the motor. Common motors used in such mechanisms include a DC motor which changes speed and direction in relation to the level and polarity of DC voltage applied thereto, and a stepper motor which changes speed and direction in response to intermittent pulses. The stepper motor is less effective at providing precise position control as compared to the DC motor plus shaft encoder; but, the stepper motor is advantageously less expensive than the DC motor and encoder.

One problem that plagues shuttle-type printers is the inherent lack of precise positional control due to mechanical tolerances of the shuttle drive mechanism. The motor and drive belt assembly possess manufacturing variances that induce slight, but acceptable, errors in the shuttle positioning process. These errors are manifest in assembled printers and vary from printer to printer. Accordingly, it would be advantageous to identify the inherent mechanical errors within an assembled printer and compensate for them.

Another problem associated with printers concerns maintaining consistent print quality. Generally, print quality tends to deteriorate over time. This deterioration may be the result of mechanical wear or other factors such change in ink drop-volume (for ink-jet printers) or variations in pin impact (for dot matrix printers). While degradation in print quality is traditionally detected by the user, it would be desirable to provide an automated approach to monitoring print quality.

Another problem relates to printer versatility. Printers are often called upon to print on a wide variety of recording media having different widths and printing surfaces. Common recording media include standard $8\frac{1}{2}\times 11$ inch paper, A4 paper, and B4 paper. Additionally, printers are increasingly used to print bar codes or other information on narrow, adhesive-backed labels. Prior art printers detect various paper size using complex media feed sensors provided in the printer throat, or by sensing the type of tray used to store the media that is inserted into the printer. It would be advantageous to provide a simple, low cost method for detecting media width.

Aspects of this invention overcome the above drawbacks by providing a low cost, automated system and associated operating methods for determining absolute carriage position relative to the platen, monitoring print quality, and measuring media width.

DISCLOSURE OF THE INVENTION

According to one aspect of this invention, a printing system for a shuttle-type printer includes a platen and a carriage mounted adjacent to, but spaced from, the platen to permit passage of a recording media therebetween. The media flows along a media feed path having a width effective to cover a first portion of the platen while leaving exposed a second portion of the platen. The carriage is configured to move bidirectionally across the platen to be positionable (1) over the first portion of the platen associated with the media path, and (2) over the second portion of the platen outside of the media path. An optically responsive demarcation in the preferred form of an aperture is provided in the second portion of the platen outside of the media path. The printing system also includes a printhead disposed on the carriage to form printed images on the recording media. An optical sensor is also disposed on the carriage, whereby the optical sensor has a light source oriented to emit a light beam toward the platen and a light sensitive detector aligned to detect reflected light.

The carriage is operable to position the optical sensor over the platen demarcation, whereby the optical sensor generates a position signal when it detects the platen demarcation. From this signal, a control subsystem determines position of the carriage relative to the platen.

According to other aspects of this invention, the single optical sensor can be used to measure the media width, monitor print quality, and detect media skew within the printer. The printing system and methods of this invention thereby provide low cost, simple solutions to many of the problems facing conventional shuttle-type printers.

BRIEF DESCRIPTION OF THE DRAWINGS

Preferred embodiments of the invention are described below with reference to the following accompanying drawings depicting examples embodying the best mode for practicing the invention.

DETAILED DESCRIPTION OF THE PREFERRED EMBODIMENTS

Figure 1:
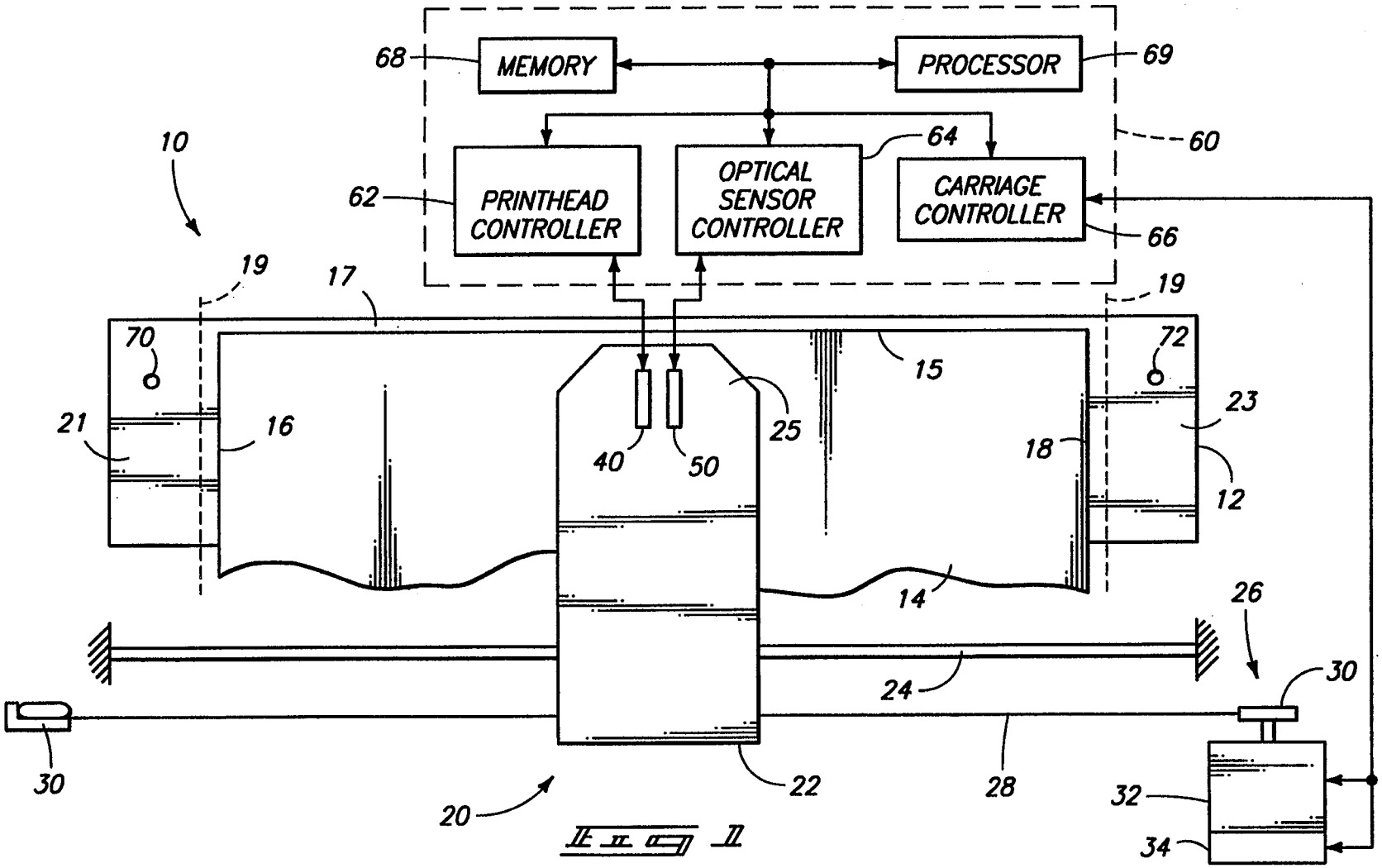
FIG. 1 is a diagrammatic illustration of a printing system for a shuttle-type printer according to this invention.

FIG. 1 shows a printing system 10 of a shuttle-type printer. System 10 includes a platen 12, a shuttle assembly 20, a printhead 40, an optical sensor 50, and a control subsystem 60. Platen 12 is preferably stationary and supports a recording media 14 during printing. Recording media 14 has an upper edge 15, a first side edge 16, and a second-side edge 18. Media 14 may be a continuous form or individual sheet stock, and it can consist of paper, adhesive-backed labels, or other types of printable matter.

A media feed mechanism (not shown), such as friction rollers or a tractor feed system, is used to drive the media through the printer along a media feed path. The media feed path is represented by dashed boundary lines 19 and has a width effective to coincide with a first portion of platen 12 while leaving exposed a second portion of the platen. More specifically, platen 12 has a center region 17 that defines media feed path 19 and two opposing end regions 21, 23 that extend beyond the media feed path.

Shuttle assembly 20 includes a carriage 22 slidably mounted on a fixed, elongated rod 24 to move bidirectionally across the platen 12. Carriage 22 preferably maneuvers over the full width of the platen to be positionable over the media feed path 19 at the platen center region 17 and over the two opposing end regions 21, 23 outside of media feed path 19. Carriage 22 has a nose section 25 that is adjacent to, but spaced from, the platen 12 to permit passage of the recording media 14 therebetween.

Shuttle assembly 20 further includes a drive subassembly 26 that is mechanically coupled to drive carriage 22 back and forth along rod 24. Drive subassembly 26 includes a wire or belt 28 attached to carriage 22 and wound around opposing pulleys 30, and a motor 32 connected to power one of the pulleys. Preferably, motor 32 is a stepper motor, but a DC motor can also be used. A rotary encoder 34 is coupled to the motor drive shaft to monitor incremental shaft rotation. This incremental count provides feedback data for use in positioning and controlling the carriage. The shuttle assembly 20 is illustrated in one typical form for explanation purposes and its construction is well known in the art. However, other types of shuttle assembly configurations may be employed in this invention.

Printhead 40 is mounted on nose section 25 of carriage 22 in juxtaposition with platen 12. Printhead 40 is diagrammatically represented as a block on nose section 25 of carriage 22 and can be embodied as an ink-jet printhead, a dot matrix printhead, a daisy-wheel, or any other type of printhead carried on a shuttle.

An optical sensor 50 is also mounted on carriage 22 to be positionable above platen 12 and/or media 14. Optical sensor 50 includes a light source (e.g., photoemitter, LED, laser diode, super luminescent diode, fiber optic source) oriented to emit a light beam toward platen 12 and a light sensitive detector (e.g., photodetector, charged couple device, photodiode) aligned to detect light reflected from the platen or media. Optical sensor 50 is preferably mounted adjacent to, and in substantial alignment with, the printhead 40 to monitor lines of text or other images that have already been printed.

The control subsystem 60 of printing system 10 consists of various components used to monitor and control operation of the printing system. It includes a printhead controller 62, an optical sensor controller 64, a carriage controller 66, a memory 68, and a processor 69. These components are illustrated in block form for clarity of discussion. Printhead controller 62 is electrically coupled to printhead 40 to manage the tasks associated with transforming digital data downloaded to the printer into desired patterns to be applied on the recording media. Optical sensor controller 64 is electrically coupled to monitor signals generated by optical sensor 50. Carriage controller 66 is configured to manage motor 32 and receive incremental motion feedback from rotary encoder 34 to controllably position carriage 22 at selected locations relative to platen 12 or media 14. Memory 68 is preferably a non-volatile, randomly accessible memory which stores position-related information. In practice, control subsystem 60 is embodied as one or more microprocessors, microcontrollers, ASICs, or other circuitry and logic.

Printing system 10 also has at least one optically responsive platen demarcation 70 provided at one end 21 of platen 12. Preferably, a platen demarcation is provided at each of the two opposing end regions 21 and 23 outside of media feed path 19, as shown by demarcations 70 and 72, respectively. In this manner, when media 14 is fed through printing system 10 between carriage 22 and platen 12, the demarcations 70 and 72 remain exposed beside the media.

The demarcations possess a distinctly different optical density as compared to that of the platen to induce a detectable change in signal output when the optical sensor 50 passes over the demarcation. In the preferred embodiment, the demarcations are embodied as apertures formed in the platen, but they can alternatively, by way of example only, comprise a reflective coating or light absorbing material applied to the platen. The demarcations 70, 72 are used in conjunction with optical sensor 50 to enable measurement of absolute carriage position relative to platen 12, as will be described below in more detail.

Carriage Position Control

The printing system 10 is capable of conducting many diverse tasks. One task of this invention involves determining absolute carriage position relative to the platen. Carriage 22 is moved to platen end region 21 beyond the media feed path 19 to align optical sensor 50 with optically responsive platen demarcation 70. When optical sensor 50 overlies demarcation 70, the emitted light beam passes partially through the aperture resulting in less reflectance. This yields a detectable transition in light reflectance from platen 12 to aperture 70, causing a variation in the signal output from optical sensor 50. In other words, the optical sensor generates a position signal (i.e., a change in signal level) when it detects platen demarcation 70. Upon receipt of the position signal, the control subsystem 60 can monitor the carriage position via carriage controller 66 and determine an absolute position of carriage 22 relative to platen 12.

Another technique according to this invention involves identifying the inherent mechanical-induced position errors of the printing system and then compensating for them. From its position over the first platen demarcation 70, the carriage 22 is moved away from the demarcation 70 across the platen 12 and beyond the media feed path 19 to the opposing end region 23. The carriage movement is halted when the optical sensor 50 is aligned with and detects second optically responsive platen demarcation 72. Upon detection, the reflectance level changes and the optical sensor 50 generates a second position signal.

As the carriage 22 traverses the platen, a rotary encoder 34 outputs pulses for each incremental step. The pulses are fed to carriage controller 66 and conveyed to processor 69. The processor counts the pulses to measure a displacement distance traveled by the carriage 22 from its initial position above platen demarcation 70 to its final position above demarcation 72. Processor 69 can then compare the displacement distance to an ideal distance value stored in memory 68 to derive a carriage position error.

As an example of this method, assume that the platen demarcations 70 and 72 are nine inches apart and the printer is configured to print 300 dots per inch (dpi). The ideal count stored in memory is 2700 steps (i.e., 9 inches×300 incremental steps/inch=2700 steps). However, if the encoder returns an actual displacement distance of 2695 steps, the printing system has an inherent error of 5 steps which equates to a carriage position error of 1/60th inch for the nine inch range.

The carriage position error is most likely a result of imprecise mechanical aspects inherent in the carriage assembly 20. Because the demarcations 70 and 72 provide a fixed scale which is known by control subsystem 60, the position performance of carriage assembly 20 can be isolated and evaluated for inherent error. The mechanically-induced error is likely to remain approximately constant throughout the prescribed life of the printer. Accordingly, once this error is measured, the printing system 10 can be adjusted to compensate for it. Alternatively, some errors become manifest over time due to mechanical wear and the like. Using the unique techniques described herein, the printer can periodically measure the errors and dynamically alter operating parameters to correct for the errors.

Figure 2:
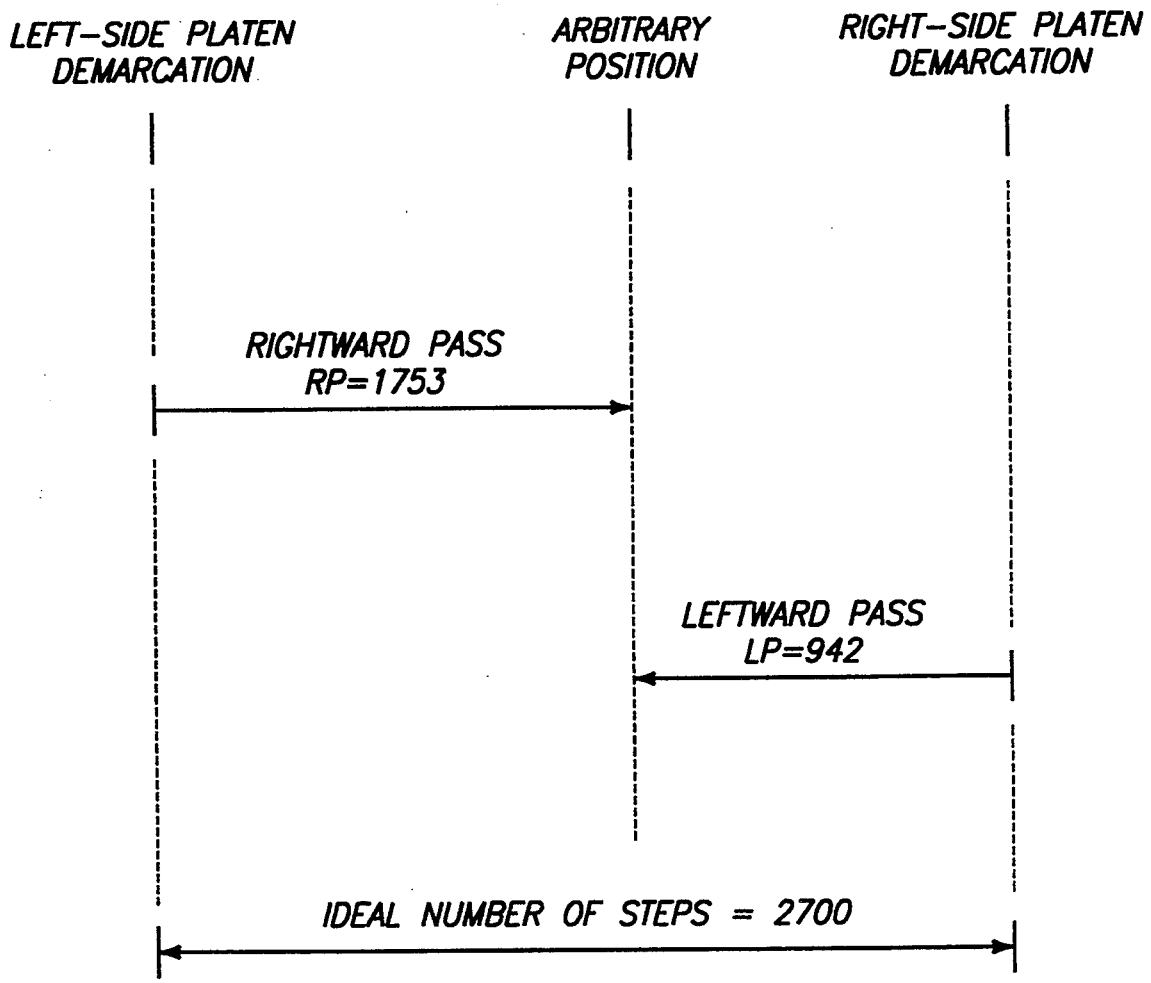
FIG. 2 is a drawing used to demonstrate a method for determining carriage position.

Detecting and adjusting for tolerance error is explained in more detail with reference to FIG. 2. This example assumes the above error of 5 incremental steps (1/60th inch) over a nine inch range. An arbitrary position over the recording media is selected by the printer. The carriage is initially positioned over the left-side platen demarcation 70 and then moved to the arbitrary position. Control subsystem 60 monitors the distance traveled during the rightward pass and measures a rightward pass RP count of, say, 1753 steps. The carriage is then moved to the right-side platen demarcation 72 to initiate a leftward pass back toward the arbitrary position. For this operation, the leftward pass LP count is, say, 942 steps. The sum of the two passes yields a total count of 2695, which reflects the presumed error of 5 steps.

Now assume the printer is adjusted to compensate for the inherent 1/60th inch error (for the nine inch range). The location of the arbitrary position relative to the demarcations is known by the processor 69. If the arbitrary position is ideally located at the 17561h step from the left-side demarcation, the control subsystem would output position control information indicative of a slightly lower value, such as 1753 steps, to correct the mechanical error in the carriage assembly 20.

Corrected values for negating the effects of the position error can be computed in a variety of ways. One technique, used in the above example, is to derive a corrected value which is proportional to the distance across the platen. For instance, to accommodate for a −5 step error in a 2700 step range, the control subsystem subtracts one step for every 540 steps made by the carriage across the platen. Another technique is to fully correct for the entire 5 step error each time the carriage changes direction. This would compensate for errors induced by, for example, excessive slack in the belt 28.

The system of this invention is advantageous because it provides a low cost solution to mechanical error inherent in carriage assemblies. The system is well suited for low cost printers which employ less precise stepper motors, as the unique control process yields higher precision results comparable to those obtained by more expensive printers.

Print Quality

Another method according to this invention concerns a simple, low cost approach to monitoring print quality. Once media 14 is fed into the printing system, optical sensor 50 takes a sample reading of the media to establish a background reflectance level. This level is stored in memory 68. The carriage 22 is then moved to a location having a marking of a selected optical density different than that of the media. By way of example only, the marking can be permanently provided on the platen or alternatively, preprinted on the recording media or deposited thereon by the printhead 40. The optical sensor 50 takes another sample reading of the marking to establish a foreground reflectance level different than the background reflectance level. The foreground reflectance level is also stored in memory 68.

The printer is then operated in its normal printing mode to print images on the recording media 14. The optical sensor 50 routinely monitors the printed images and compares the sensed images with the background and foreground reflectance levels stored in memory 68 to detect any changes in reflectance of the sensed images. Over time, the print quality of the printed images degrades (due to shortage of ink, change in pin impact strength, etc.), causing an identifiable change in reflectance. When the monitored reflectance changes relative to the preferred stored levels, the control subsystem 60 warns the user that the print quality may be deteriorating.

Media Width

Figure 3:
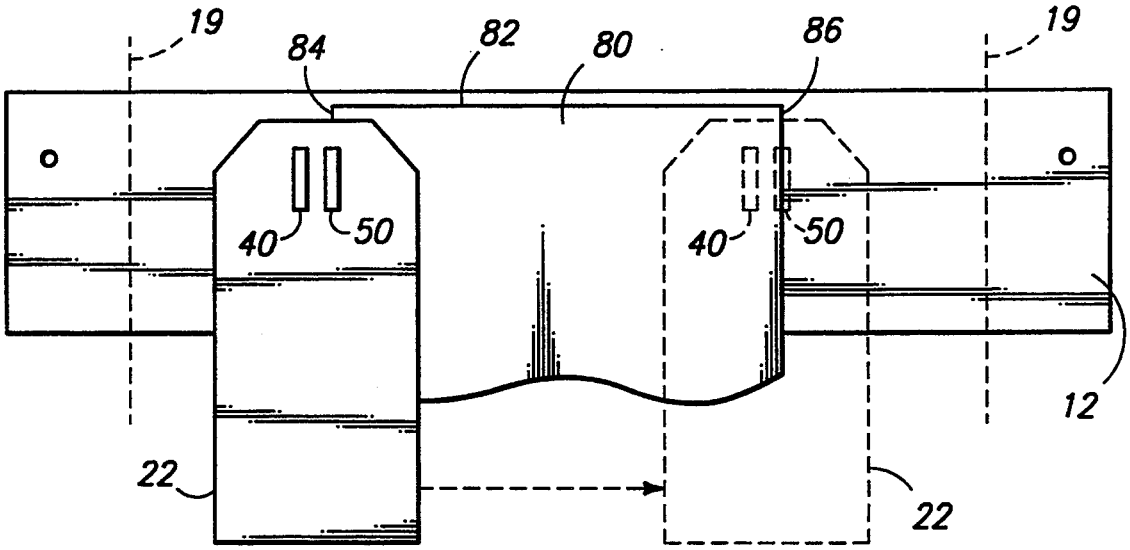
FIG. 3 is a diagrammatic drawing showing a technique for measuring media width.

FIG. 3 illustrates another method of this invention involving the optically measuring media width. In this example, a narrow recording media 80 (such as a roll of adhesive-backed labels) is fed between platen 12 and carriage 22 along media feed path 19. Media 80 has an upper edge 82, a first side edge 84, and a second side edge 86. Media 80 has an optical density different than that of platen 12.

According to this method, carriage 22 is moved across the platen 12 while optical sensor 50 simultaneously monitors light reflectance. Because the optical densities of the media 80 and the platen 12 are different, the reflectances associated with the media and platen are likewise distinct and discernable. The carriage 22 is first moved until optical sensor 50 detects the first side edge 84 of the recording media 80 resulting from a change in light reflectances during transition between the media and platen. Carriage 22 is shown in solid line at the initial position (FIG. 3). Upon detection of first side edge 84, optical sensor 50 generates a first position signal.

The carriage 22 is then moved across the media until the optical sensor detects the second side edge 86 of the recording media 80 resulting from a change in light reflectances during transition from the media to the platen. Carriage 22 is shown in phantom at this second position. Optical sensor 50 generates a second position signal upon sensing the edge.

The control subsystem 60 uses the first and second position signals to respectively commence and cease measuring the distance traveled by the carriage 22 between the first and second side edges 84 and 86. Processor 69 derives the width of the recording media 80 based upon the distance traveled by the carriage.

Media Skew

Figure 4:
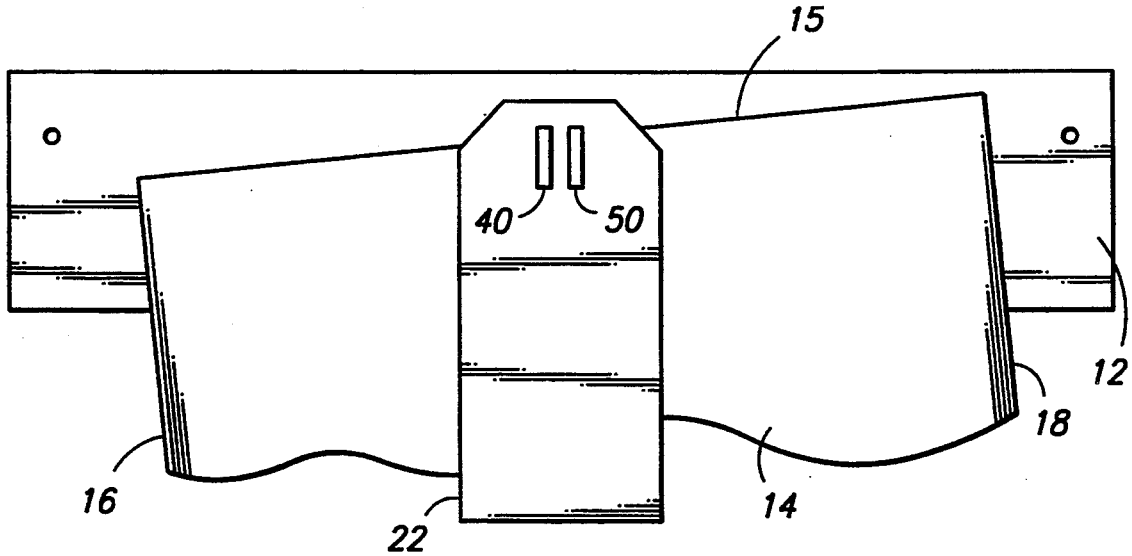
FIG. 4 is a diagrammatic drawing showing a unique approach to detecting media skew within a printer.

FIG. 4 illustrates a method of this invention involving the detection of media skew within the printer. In this example, media 14 is skewed an exaggerated amount to demonstrate the process. The method is similar to that described above with respect to measuring media width; except-here, the carriage 22 is repeatedly moved back and forth across platen 12 in a series of carriage passes to create a set of first and second position signals indicative of carriage location when the first and second side edges are detected. The position signals accordingly correlate to media position within the printer. The set of first and second position signals are stored in memory 68 to construct a position profile indicative of media position. Alternatively, a predefined position profile can be stored in the memory in relation to the type and size of media being fed through the printer.

As the media is fed through the printing system, the control subsystem 60 selectively monitors the first and second position signals output by sensor 50 during individual carriage passes and compares these samples with the position profile stored in memory 68. Media skew is discovered when the periodic sample signals fail to conform to the profile. The control subsystem 60 outputs a warning to alert the user that the media is off course, and in some cases, will halt printing altogether. Alternatively, the control subsystem 60 can shift the printing to compensate for the skew.

The system and methods of this invention are advantageous because they provide simple, low cost, and automated approaches to determining absolute carriage position relative to the platen, monitoring print quality, measuring media width, and detecting media skew. All of these characteristics can be accounted for using a single optical sensor mounted on the carriage, one or more demarcations on the platen, and special control circuitry. Accordingly, very little modification of present printers is necessary to obtain the desired benefits of this invention.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A printing system for a shuttle-type printer, comprising:

a platen;

a carriage adjacent to, but spaced from, the platen to permit passage of a recording media therebetween along a media feed path, the media feed path having a width effective to cover a first portion of the platen while leaving exposed a second portion of the platen;

the carriage being configured to move bidirectionally across the platen to be positionable (1) over the first portion of the platen associated with the media path, and (2) over the second portion of the platen outside of the media path;

a printhead disposed on the carriage to form printed images;

an optically responsive platen demarcation formed as an aperture in the second portion of the platen outside of the media path;

an optical sensor disposed on the carriage, the optical sensor having a light source oriented to emit a light beam toward the platen and a light sensitive detector aligned to detect reflected light, the optical sensor generating a position signal when the platen demarcation is detected; and a control subsystem operably coupled to the optical sensor to determine position of the carriage relative to the platen in response to optical identification of the platen demarcation by the optical sensor.

2. A printing system according to claim 1 wherein:

the platen has a center region and two opposing end regions, the center region defining the first portion of the platen and the end regions defining the second portion of the platen;

the printing system further comprises:

an optically responsive platen demarcation formed as an aperture in the platen at each of the two opposing end regions, the carriage being operable to position the optical sensor sequentially over a first platen demarcation at one end region of the platen and then over a second platen demarcation at the other end region of the platen; and a monitor for measuring the distance traveled by the carriage from the first demarcation to the second demarcation.

3. A printing system according to claim 1 wherein:

the platen has a center region and two opposing end regions, the center region defining the first portion of the platen and the end regions defining the second portion of the platen; and the printing system further comprises an optically responsive platen demarcation formed as an aperture in the platen at each of the two opposing end regions.

4. A method of operating a shuttle-type printer, the method comprising the following steps:

providing a platen having at least first and second optically responsive demarcations provided thereon, the first and second demarcations on the platen being separated by an ideal displacement distance;

providing a carriage which moves bidirectionally across the platen;

providing an optical sensor on the carriage:

moving the carriage in a direction across the platen and until the optical sensor detects the first optically responsive demarcation on the platen:

generating a first position signal when the first platen demarcation is optically detected;

moving the carriage in a direction away from the first platen demarcation across the platen and until the optical sensor detects the second optically responsive demarcation on the platen;

generating a second position signal indicative of a final position of the carriage relative to the platen in response to optically detecting the second platen demarcation;

measuring a displacement distance traveled by the carriage from the initial position to the final position;

comparing the measured displacement distance with the ideal displacement distance;

deriving an error when the measured displacement distance is not identical to the ideal displacement distance; and compensating for discrepancy between the measured and ideal displacement distances in response to the error during subsequent movement of the carriage to improve positional accuracy of the carriage across the platen.

5. A method according to claim 4 comprising the following additional steps:

feeding a recording media between the platen and carriage along a media path in a manner that leaves the first optically responsive platen demarcation exposed beside the recording media; and moving the carriage beyond the recording media and until the optical sensor detects the first platen demarcation.

* * * * *